US012594638B2

(12) United States Patent
Wagman, III

(10) Patent No.: US 12,594,638 B2
(45) Date of Patent: Apr. 7, 2026

(54) SURFACE PROCESSING DEVICE AND METHODS OF USE THEREOF

(71) Applicant: Wagman Metal Products Inc., York, PA (US)

(72) Inventor: George Frederick Wagman, III, York, PA (US)

(73) Assignee: Wagman Metal Products Inc., York, PA (US)

( * ) Notice: Subject to any disclaimer, the term of this patent is extended or adjusted under 35 U.S.C. 154(b) by 274 days.

(21) Appl. No.: 17/817,850

(22) Filed: Aug. 5, 2022

(65) Prior Publication Data

US 2024/0042566 A1 Feb. 8, 2024

(51) Int. Cl.
*B24B 7/18* (2006.01)
*B24B 41/047* (2006.01)

(52) U.S. Cl.
CPC ..... *B24B 7/188* (2013.01); *B24B 41/047* (2013.01)

(58) Field of Classification Search
CPC ..... B24B 7/188; B24B 7/18; B24B 7/186; B24B 41/047; B24B 47/10
USPC ..... 451/28, 211, 350, 352, 353
See application file for complete search history.

(56) References Cited

U.S. PATENT DOCUMENTS 4,155,596 A * 5/1979 Brejcha ..... B24B 7/186 299/39.1
7,033,258 B2 * 4/2006 Jordan ..... B24B 7/186 451/353
2010/0067984 A1 * 3/2010 Thysell ..... E04F 21/245 404/114
2010/0190421 A1 * 7/2010 Hamm ..... B24B 7/186 451/353
2018/0058080 A1 * 3/2018 Snyder ..... B24D 18/009
2019/0389034 A1 * 12/2019 Laforest ..... B24B 7/186
2021/0047845 A1 * 2/2021 Guinn ..... E04F 21/247

OTHER PUBLICATIONS

Office Action (Requisition By the Examiner) issued on Jan. 6, 2025, by the Canadian Intellectual Property Office in Canadian Patent Application No. 3,208,232 (3 pages).

* cited by examiner

*Primary Examiner* — Michael A Gump
(74) *Attorney, Agent, or Firm* — Buchanan Ingersoll & Rooney PC

(57) ABSTRACT

Embodiments relate to a surface processing device that may be used to surface process concrete or other hard suitable surfaces. A surface processing device comprises a plate, a bearing, and a plurality of bush heads. The plate has a top and bottom. The bearing can be attached to the top of the plate to facilitate rotation of the plate. The plurality of bush heads can be attached to the bottom of the plate. Each bush head comprises a bracket and a grinding wheel.

12 Claims, 12 Drawing Sheets

SURFACE PROCESSING DEVICE AND METHODS OF USE THEREOF

FIELD OF THE INVENTION

Embodiments relate to a surface processing device generally and methods of use thereof. More particularly, embodiments relate to a surface processing device for surface processing of concrete or other hard surfaces and methods of use thereof.

BACKGROUND OF THE INVENTION

Scarification is a resurfacing process where a pummeling action is used to chip away at the surface being treated. Scarification is used to remove debris, correct for or address surface irregularities, or otherwise treat the surface of concrete, metal, or other hard surfaces. Scarifiers can employ different types of attachments for pulverizing the surface, such as bush heads fixed to a rotating plate. However, scarification can often lead to undesirable patterns generated on the surface or even a non-uniform surface (i.e. an undulating surface). For example, scarifiers with the aforementioned bush heads result in distinct circular patterns. Often, to mitigate scarification patterning and undulating surfaces, a trained operator is required. Moreover, when scarification does result in patterning or an undulating surface, the operator will possibly have to redo the scarification process or employ additional techniques, such as shot blasting, to rectify the treated surface.

Shot blasting, an alternative or supplemental method to scarification, is a resurfacing process where abrasive particles are propelled at a surface under high pressure. Use of shot requires undesirable pre-operation preparation (e.g., containment of shot as it is being propelled) and post-operation clean up (cleaning up and disposing of waste shot). In addition, the abrasive particles used in this process can be toxic, can leak in the form of hazardous dust, and present other environmental hazards—consequently, requiring even more pre- and post-operation steps to contain and clean the abrasive material. Moreover, equipment used for shot blasting is equipment that is not configured for use with other surface processing equipment—e.g., conventional surface processing equipment (e.g., ride-on or walk-behind surface processing machine) cannot be adapted or retrofitted to use shot, and thus additional equipment is required to provide the type of surface treatment that shot blasting affords. Accordingly, there is a clear need for a device that can be used in conjunction with, to augment, or bypasses the use of abrasive particles for resurfacing concrete or other hard surfaces.

SUMMARY OF THE INVENTION

Embodiments relate to a surface processing device that may be used to surface process concrete or other hard suitable surfaces. A surface processing device comprises a plate, a bearing, and a plurality of bush heads. The plate has a top and bottom. The bearing can be attached to the top of the plate to facilitate rotation of the plate. The plurality of bush heads can be attached to the bottom of the plate. Each bush head comprises a bracket and a grinding wheel.

In some embodiments, at least one bush head can be pivotally attached to the bottom of the plate.

In some embodiments, the plurality of bush heads can include four bush heads.

In some embodiments, at least one bush head can include a plurality of projections on its grinding wheel.

In some embodiments, at least one projection can be in the shape of a cone, pyramid, cylinder, or prism.

In some embodiments, at least one bush head can be removably attached to the bottom of the plate.

In some embodiments, the bearing can be configured to engage with a spider arm of a rotatable spider assembly.

In some embodiments, the bearing can be configured to allow free rotation of the plate relative to the spider arm.

In some embodiments, the surface processing device further comprises a plurality of pivotal attachments, each pivotal attachment can be interposed between the plate and the plurality of bush heads.

In some embodiments, at least one pivotal attachment can be configured to allow free rotation of at least one bush head relative to the plate.

In some embodiments, at least one bush head can include an axle connected to its grinding wheel.

In some embodiments, the grinding wheel can be configured to allow free rotation of the grinding wheel about its axle.

In some embodiments, the plate can have a circular profile.

In some embodiments, the plate can have a center and the plurality of bush heads can be equidistant from the center of the plate.

In some embodiments, the plate can have a bolt circle, wherein the plurality of bush heads can be equally spaced on a bolt circle.

An exemplary embodiment relates to a method of polishing a surface using an embodiment of a surface processing device. The embodiment of the surface processing device can have a plate, a bearing, and a plurality of bush heads. The plate has a top and bottom. The bearing can be attached to the top of the plate to facilitate rotation of the plate. The plurality of bush heads can be attached to the bottom of the plate. Each bush head comprises a bracket and a grinding wheel. The method can involve attaching the surface processing device to a spider arm of a rotatable spider assembly so that the bottom of the plate faces towards the surface. The rotatable spider assembly can have an axis of rotation. The method can involve causing the spider arm to rotate about the axis of rotation. The method can involve allowing the plurality of bush heads to make contact with the surface as the spider arm rotates.

In some embodiments, the surface polishing device is capable of passive planetary rotation.

In some embodiments, the surface polishing device can create a texturized surface, wherein the texturized surface does not possess a scarification pattern.

In some embodiments, a surface processing device comprises a plate, a bearing, and a plurality of bush heads. The plate has a top and bottom. The bearing can be attached to the bottom of the plate to facilitate rotation of the plate. The plurality of bush heads can be attached to the bottom of the plate. Each bush head comprises a bracket and a grinding wheel.

In some embodiments, a surface processing device comprises a plate and a plurality of bush heads. The plate has a top and bottom. The plurality of bush heads can be attached to the bottom of the plate. Each bush head comprises a bracket and a grinding wheel. The plate can be configured to engage with a bearing attached to a spider arm of a rotatable spider assembly. The bearing can be configured to allow free rotation of the plate relative to the spider arm.

BRIEF DESCRIPTION OF THE DRAWINGS

The above and other objects, aspects, features, advantages, and possible applications of the present innovation will be more apparent from the following more particular description thereof, presented in conjunction with the following drawings. Like reference numbers used in the drawings may identify like components.

DETAILED DESCRIPTION OF THE INVENTION

The following description is of exemplary embodiments that are presently contemplated for carrying out the present invention. This description is not to be taken in a limiting sense, but is made merely for the purpose of describing the general principles and features of various aspects of the present invention. The scope of the present invention is not limited by this description.

Figure 1:
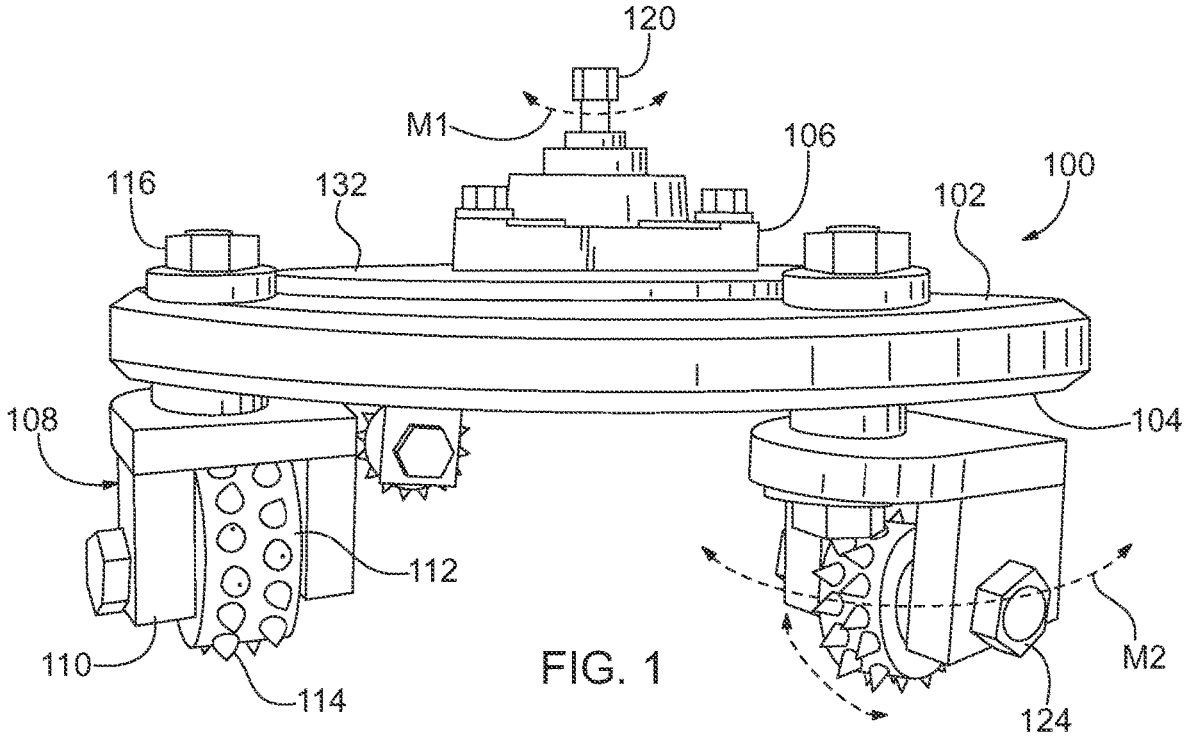
FIG. 1 is a side view of an embodiment of a surface processing device.

As seen in FIG. 1, a surface processing device comprises a plate 100, a bearing 106, and a plurality of bush heads 108. The plate 100 has a top 102 and bottom 104. The bearing 106 can be attached to the top of the plate 102 to facilitate rotation of the plate 100. Alternatively, the bearing 106 can be attached to the bottom of the plate 104 to facilitate rotation of the plate 100. The plurality of bush heads 108 can be attached to the bottom of the plate 104. Each bush head 108 comprises a bracket 110 and a grinding wheel 112.

Figure 4:
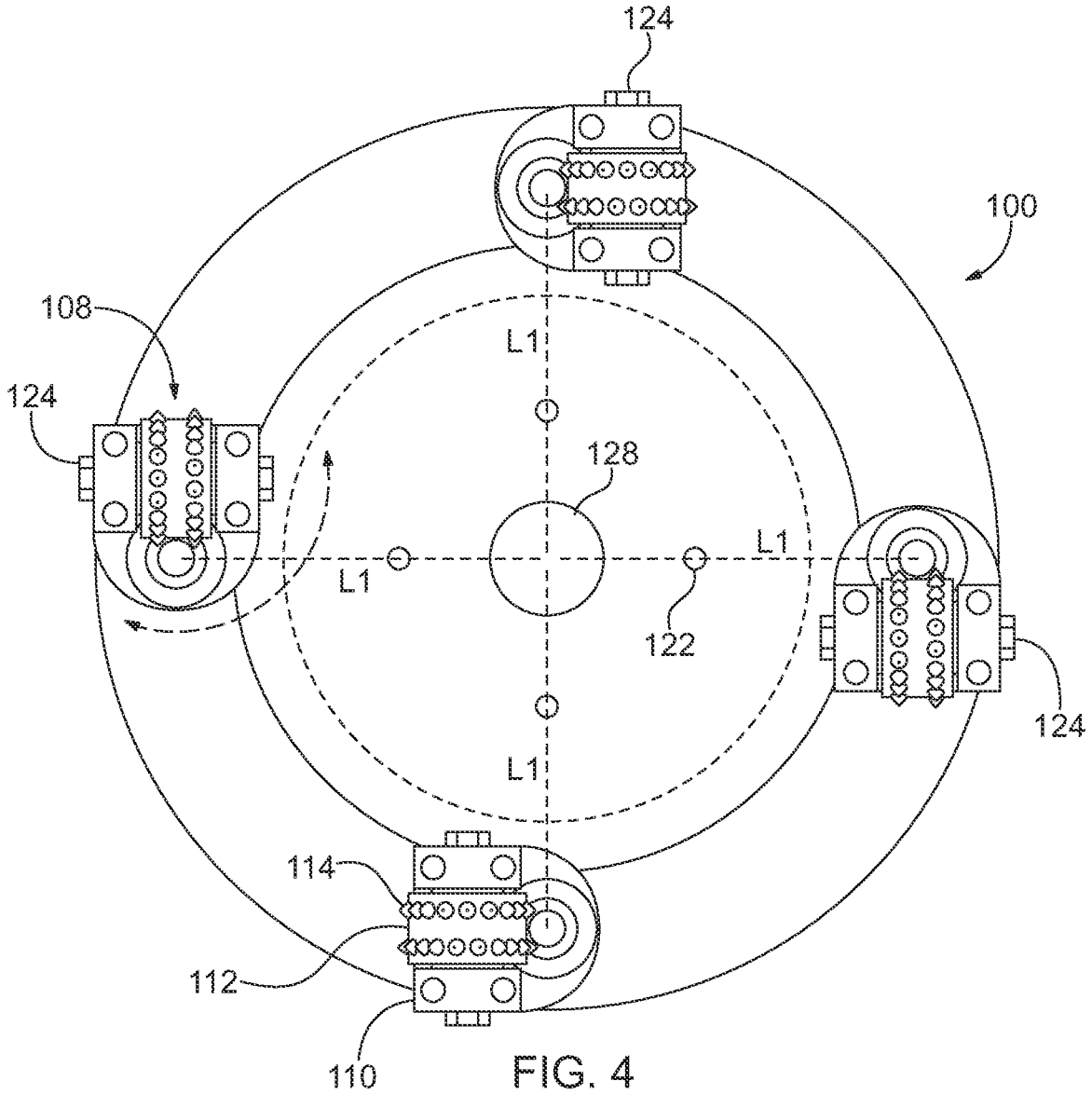
FIG. 4 is a bottom view of an embodiment of a surface processing device.

As seen in FIG. 4, the plate 100 can include a central aperture 128 for receiving a mounting shank 120 therethrough. The plate 100 can include a plurality of apertures 122 positioned around the central aperture 128 for mounting a bearing 106 onto the top 102 or bottom 104 of the plate 100. The central aperture 128 and the plurality of apertures 122 can each have an internal threaded portion for receiving a bolt having a complementary external threaded portion.

Figure 5:
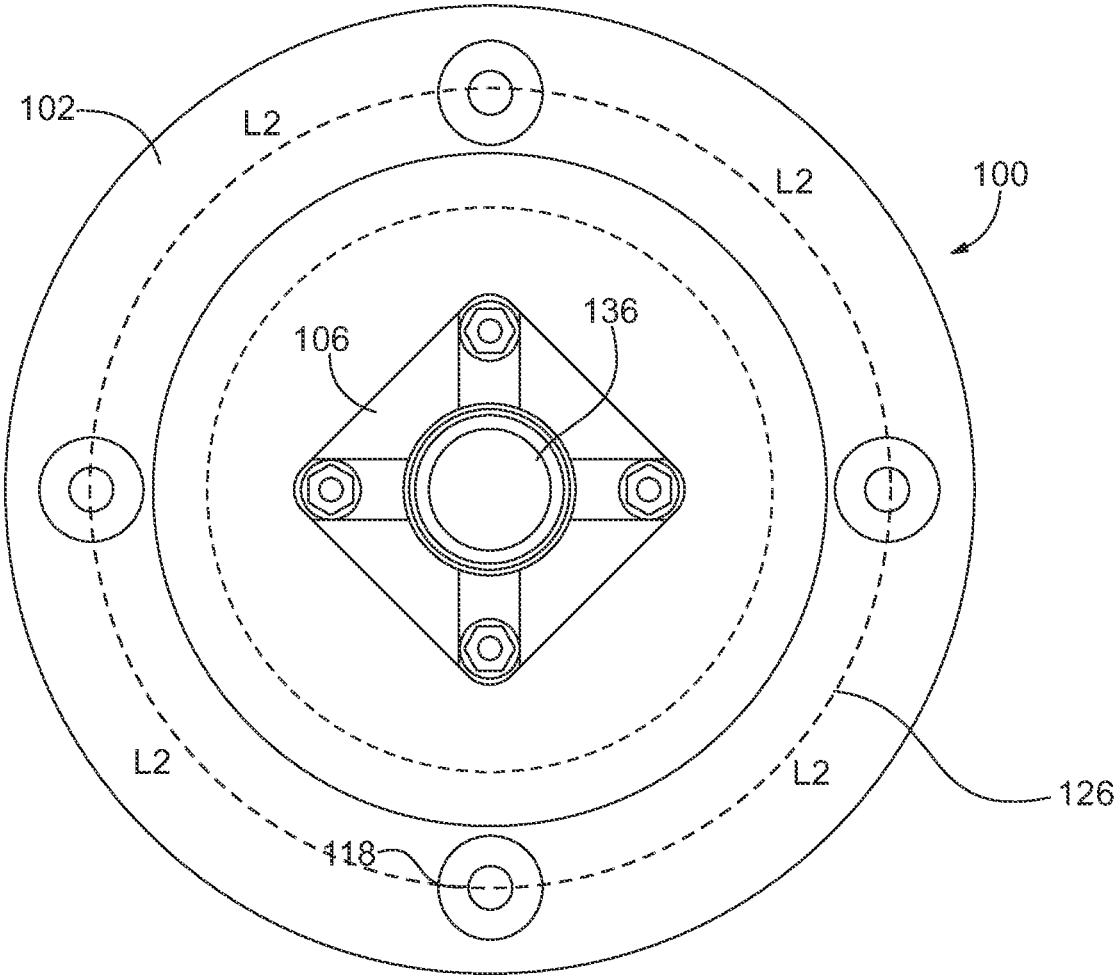
FIG. 5 is a top view of an embodiment of a surface processing device.
Figure 6:
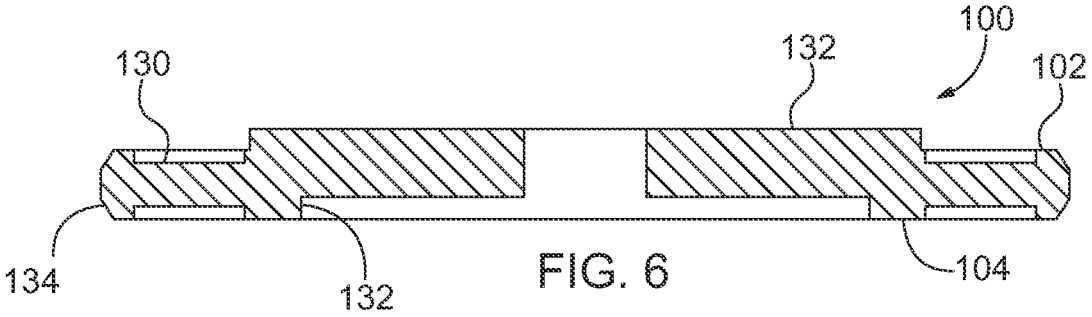
FIG. 6 is a side view of an embodiment of a plate.

As seen in FIG. 5, the plate 100 can include a second plurality of apertures 118 for coupling bush heads 108 to the plate 100. The second plurality of apertures 118 can be arranged towards the outer edge of the plate 100. The second plurality of apertures 118 can be arranged in such a way that the apertures 118 form a bolt circle 126 on the plate 100. The second plurality of apertures 118 can be equally spaced along the bolt circle 126 such that the arc length between each aperture 118 is $L_2$. As seen in FIG. 6, the second plurality of apertures 118 can each have a spot face 130. The second plurality of apertures 118 can each have an internal threaded portion for receiving a bolt having a complementary external threaded portion.

The profile of the plate 100 can be any type of shape, e.g. circle, triangle, square, etc. As seen in FIG. 6, the top 102 and bottom 104 of the plate can be flat or slightly convex. The top 102 and bottom 104 of the plate can also have a stepped portion 132. The stepped portion 132 can be raised or recessed. The stepped portion 132 can be centered on the plate 100. The top 102 and bottom 104 of the plate can have a chamfer 134 along at least a portion of the periphery of the plate 100.

Figure 3:
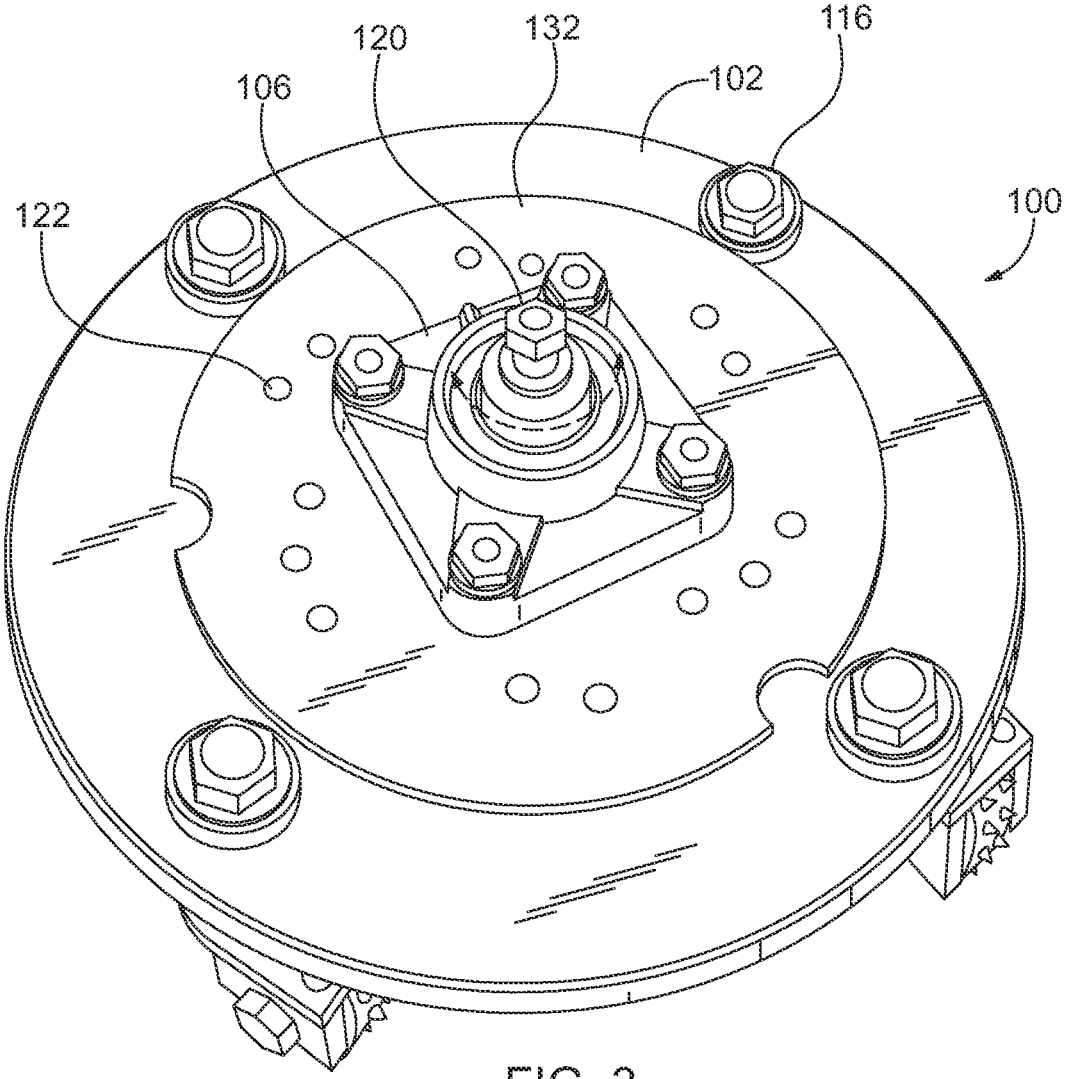
FIG. 3 is a top view of an embodiment of a surface processing device.

As seen in FIGS. 3 and 5, the bearing 106 can be mounted, e.g., via bolts and nuts, on the top of the plate 102 and positioned thereon such that the central bore 136 of the bearing 106 is concentric with the central aperture 128 of the plate 100. Alternatively, the bearing can be attached to the bottom of the plate 104 by similar means. The bearing 106 can be any type, e.g., ball bearing, roller bearing, fluid bearing, magnetic bearing, etc. The bearing 106 can be used to mount the plate 100 to a spider arm 144 of a rotatable spider arm assembly 142. Connected to the spider arm 144, the plate 100 can spin freely about its mounting axis $M_1$ which can be perpendicular or substantially perpendicular to the spider arm 144. A single spider assembly 142 can have a plurality of radially-extending, spaced-apart arms 144 and a surface processing device mounted on each arm 144.

Figure 8:
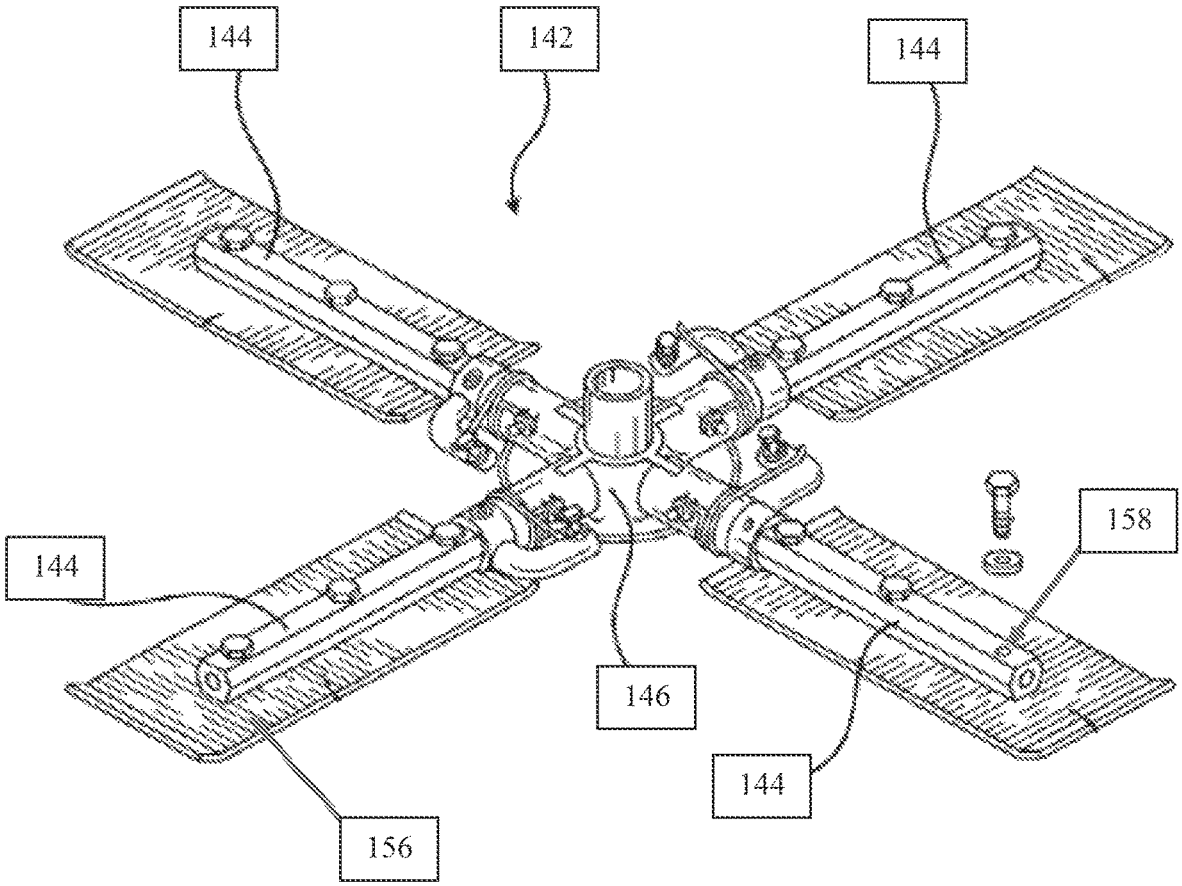
FIG. 8 shows an exemplary spider arm assembly.
Figure 9:
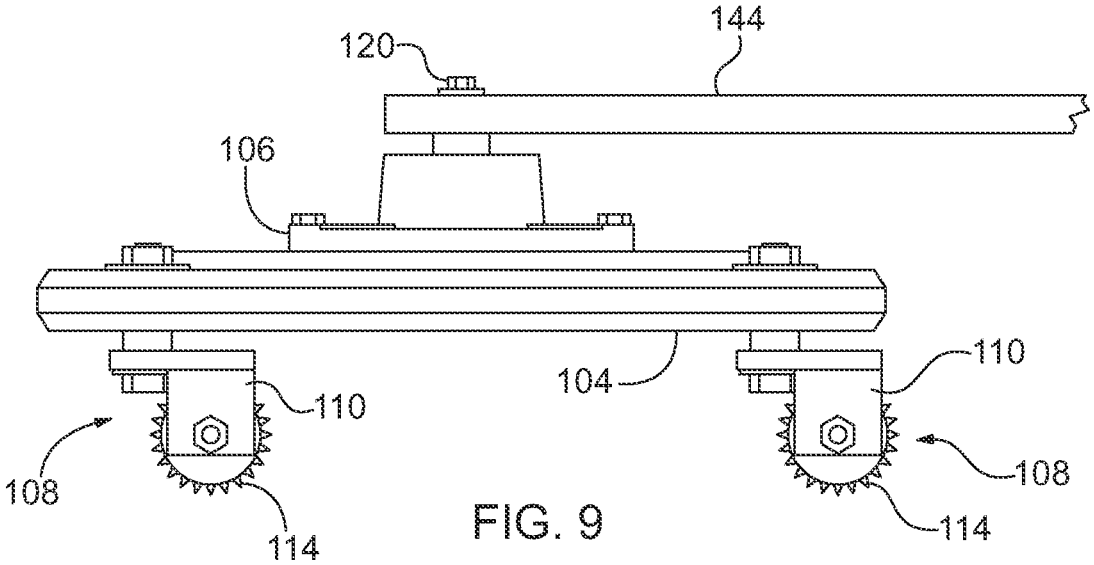
FIG. 9 shows an exemplary set up for connecting the device connected to a spider arm.

FIG. 8 shows an exemplary spider arm assembly 142 from a conventional surface processing machine 138, 150. The spider arm assembly 142 shown has trowel blades 156 attached to the spider arms 144. As will be explained herein, the device can be used with a conventional surface processing machine 138, 150. Conventional surface processing machines 138, 150 have a spider assembly 142 or a rotor 160 (details are discussed later) to which the device can be attached. This can facilitate use of already-acquired equipment to perform the shot-style surface treatment—e.g., the conventional surface processing machines 138, 150 can be adapted or retrofitted for performing such surface treatment by attaching an embodiment of the device thereto. For instance, the trowel blades 158 or other surface processing tool can be removed from the spider arms 144. The mounting shank 120 of the device can then be inserted through an aperture 158 of the spider arm 144 and connected thereto via a nut or equivalent hardware. Other means of connecting the device can include welding, for example. FIG. 9 shows an exemplary set up for connecting the device connected to a spider arm 144.

Figure 11:
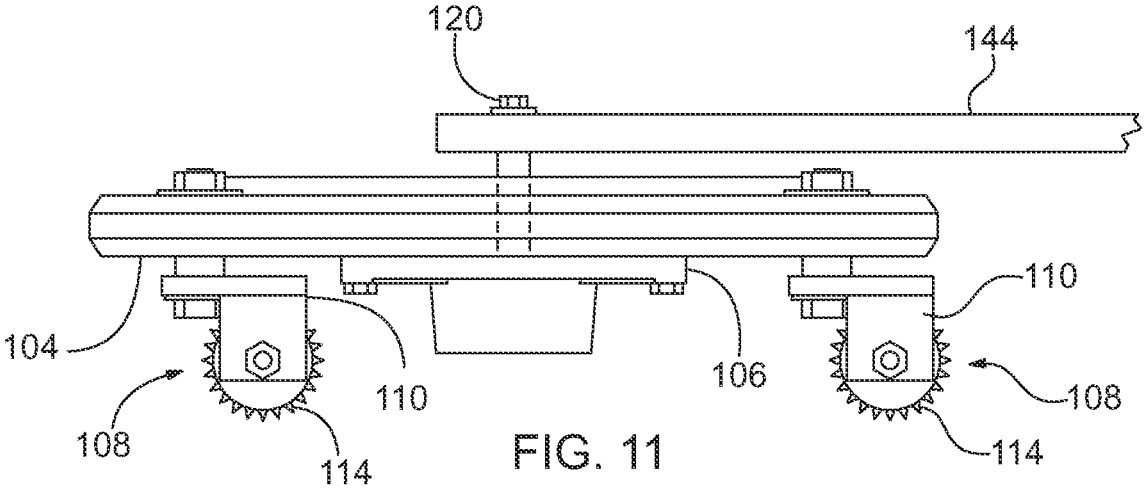
FIG. 11 shows an exemplary embodiment of the device with the bearing attached to a bottom surface of the plate.

With a bearing 106 secured in place on the top of the plate 102, a mounting shank 120 can be inserted into the central aperture 128 of the plate 100 from the plate bottom 104. The mounting shank 120 can extend through the central bore 136 of the bearing 106. The mounting shank 120 can have an end portion, and the end portion can emerge from the central bore 136 of the bearing 106. In alternative embodiments, the bearing 106 can be secured in place on the bottom of the plate 104. (See FIG. 11, for example). With the bearing 106 fixed to the bottom of the plate 104, the mounting shank 120 can extend through the central bore 136 of the bearing 106 with the end portion of the mounting shank 120 emerging from the central aperture 128. Whether the bearing 106 is secured to the top 102 or bottom 104 of the plate 100, the mounting shank 120 can be configured to the bearing 106 such that the plate 100 can freely rotate about the mounting shank 120. The end portion of the mounting shank 120 can be externally threaded and receivable through an aperture 158 having a complementary internal threaded portion. In other embodiments, the aperture 158 is not threaded but smooth. The end portion of the mounting shank 120 projecting from the bearing 106 can be securely mounted through apertures 158 on a spider arm 144 and can be retained using a lock washer and hex nut, or equivalent hardware. Alternatively, the end portion of a mounting shank 120 can be securely mounted through apertures on a mounting plate using a lock washer and hex nut, or equivalent hardware. The mounting plate can then be attached to a spider arm 144 of a rotatable spider assembly 142.

Figure 12:
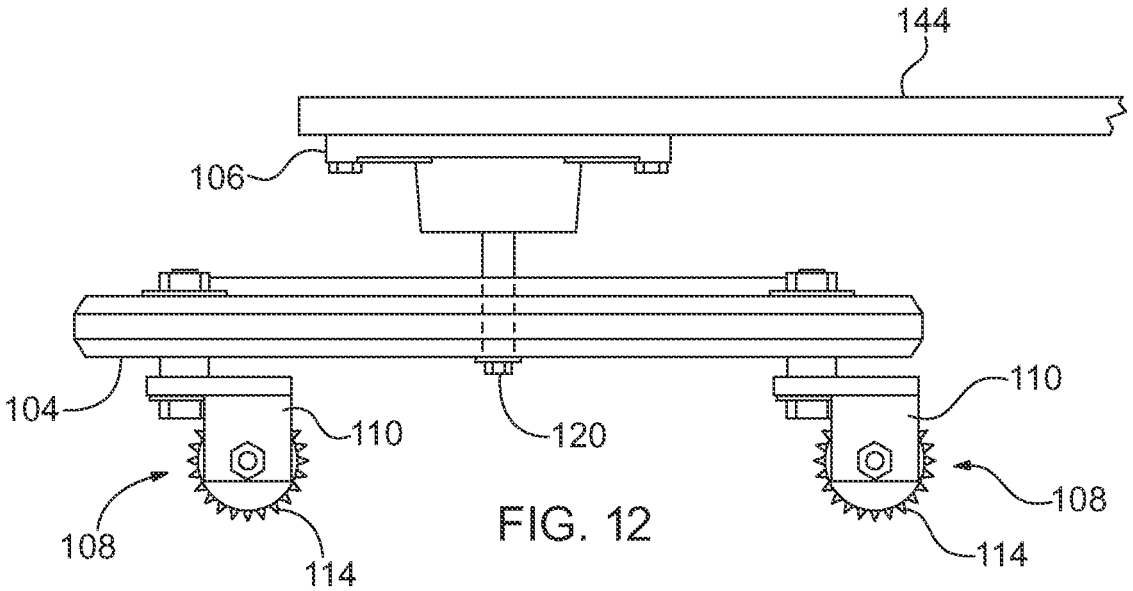
FIG. 12 shows an exemplary embodiment of the device with the bearing attached to the spider arm.

In alternative embodiments, the bearing 106 can be secured, e.g., via bolts and nuts, to the top or bottom of a spider arm 144. (See FIG. 12, for example). With a bearing 106 secured in place, a mounting shank 120 can extend through the central bore 136 of the bearing 106. The mounting shank 120, which is perpendicular to the spider arm 144, can have an end portion extending downward. Whether the bearing 106 is secured to the top or bottom of the spider arm 144, the mounting shank 120 can be configured to the bearing 106 such that the spider arm 144 can freely rotate about the mounting shank 120. The end portion of the mounting shank 120 can be externally threaded and receivable through the central aperture 128 having a complementary internal threaded portion. In other embodiments, the central aperture 128 is not threaded but smooth. The end portion of the mounting shank 120 can be securely mounted through the central aperture 128 of the plate 100 and can be retained using a lock washer and hex nut, or equivalent hardware.

Figure 2:
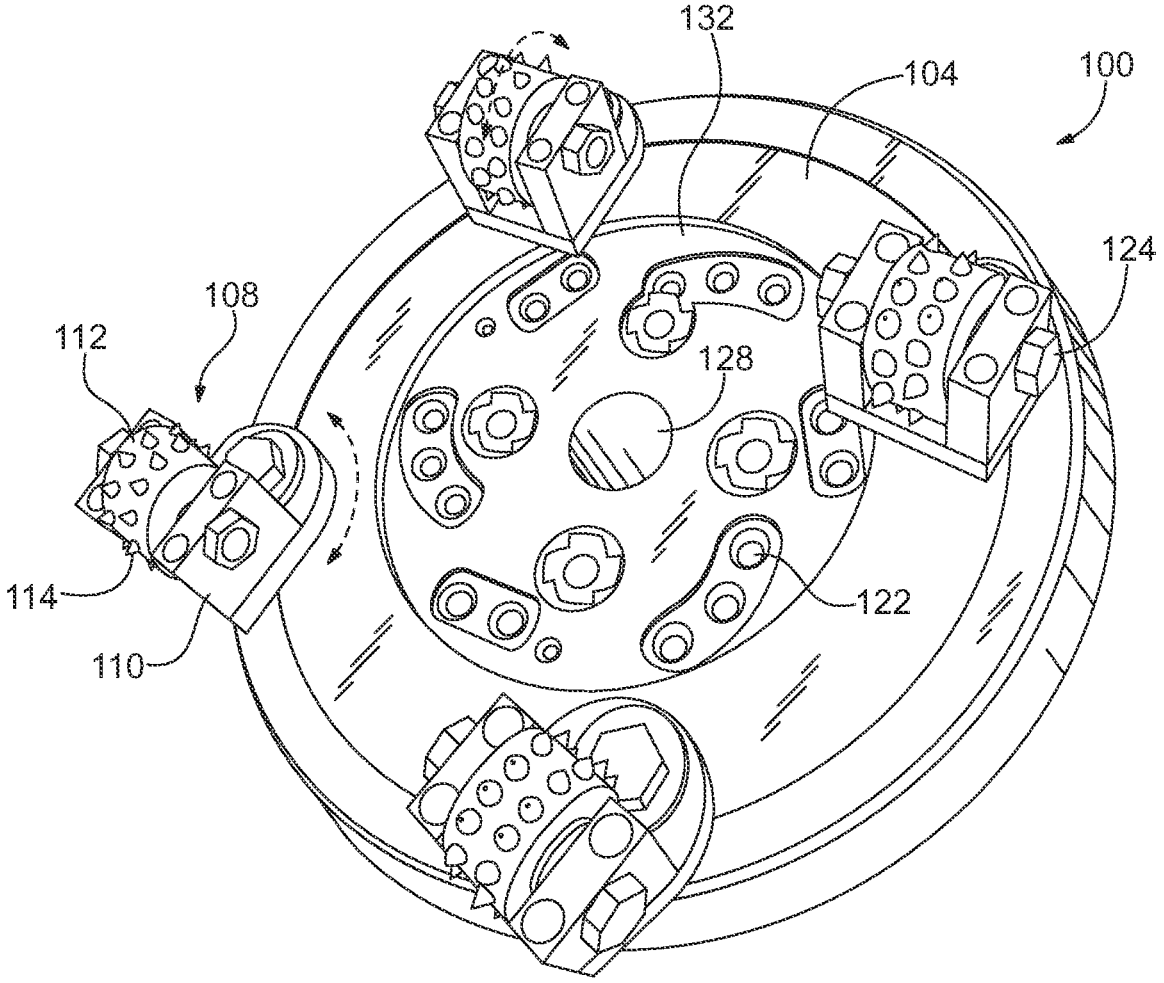
FIG. 2 is a bottom view of an embodiment of a surface processing device.

As seen in FIGS. 1, 2, and 4, a plurality of bush heads 108 can be mounted on the bottom of the plate 104 via their brackets 110. The bracket 110 of each bush head 108 can be interposed between the plate 100 and the grinding wheel 112 for securing the grinding wheel 112 to a surface processing device. The grinding wheel 112 can be oriented such that its axis of rotation is parallel to the plate 100.

Figure 10:
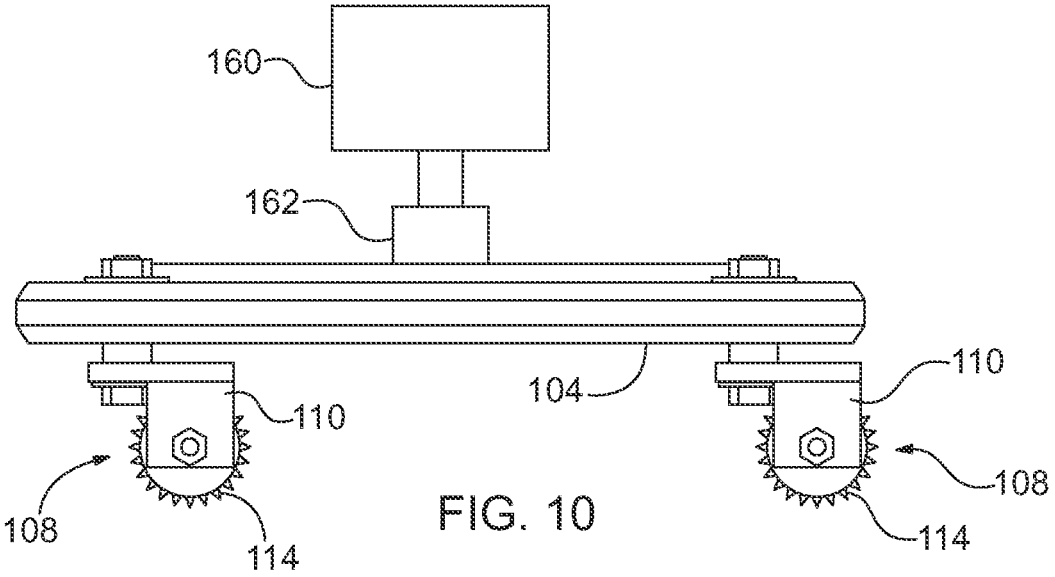
FIG. 10 show an exemplary embodiment of the device having a rotor adaptor in lieu of a bearing.

Referring to FIG. 10, in an alternative embodiment, the surface processing device can comprise a rotor adaptor 162 in lieu of the bearing 106. The rotor adaptor 162 can be mounted via the plurality of apertures 122 on the plate 100 and secured using bolts and nuts, or via other means. Once mounted on the top of the plate 102, the rotor adaptor 162 can be used to attach the plate 100 to a rotor (e.g., a powered rotary tool or motor). Connected to the rotor 160, the mounting axis $M_1$ of the plate 100 can be aligned with the axis of rotation of the rotor 160. The rotor adaptor 162 can be configured to the plate 100 and the rotor 160 such that as the rotor 160 spins, the plate 100 spins as well.

It should be noted that when the device is attached to a spider arm 144, the plate 100 can either freely rotate about the mounting shank 120/spider arm aperture 158 connection or be rigidly attached at that connection so as to not freely rotate. When the device is attached to the rotor 160, it is rigidly attached so that the rotation of the rotor causes the plate 100 to rotate as well.

At least two bush heads 108 can be securely attached to the bottom of the plate 104—e.g., the brackets 110 of the at least two bush heads 108 can be securely attached to the bottom of the plate 104. In some embodiments, the plurality of bush heads can include four bush heads. At least one bush head 108 can be welded to the plate 100—e.g., the bracket 110 of the at least one bush head 108 can be attached to the bottom of the plate 104 via a weld. Alternatively, a second plurality of apertures 118 on the plate 100 can be provided for removably mounting the bush heads 108. At least one bush head 108 can be mounted via bolts and nuts—e.g., the bracket 110 of the at least one bush head 108 can be attached to the bottom of the plate 104 via bolts and nuts. Alternatively, at least one bush head 108 can be pivotally attached to the bottom of the plate 104—e.g., the bracket 110 of the at least one bush head 108 can be attached to the bottom of the plate 104 via a pivotal attachment 116. Pivotally attached bush heads 108 can be mounted to the plate 100 via pivotal attachments 116. The pivotal attachments 116 can secure the bush heads 108 to the bottom of the plate 104 in a caster wheel-like fashion. Each pivotal attachment 116 can be interposed between the bottom of the plate 104 and a bracket 110. The pivotal attachments 116 can be bearings which allows the brackets 110 (and therefore the bush heads 108) to spin freely about their mounting axes $M_2$ perpendicular to the plate 100. The bearings can be any type, e.g., ball bearing, roller bearing, fluid bearing, magnetic bearing, etc. The second plurality of apertures 118 can each have a spot face 130 such that the mounting mechanism—e.g. bolt and nut or bearing—lies flush with or extends out less from the top of the plate 102. As seen in FIG. 4, the plurality of bush heads 108 can be mounted such that each bush head 108 is equidistant from the center of the plate 100 with a length of $L_1$. As seen in FIG. 5, the plurality of bush heads 108 can be mounted along a bolt circle 126 such that the bush heads 108 are equally spaced along the bolt circle 126 where the arc length between each bush head 108 is $L_2$.

At least one grinding wheel 112 can include a central bore for mounting the grinding wheel 112 on an axle 124. The axle 124 can be secured to the bracket 110 so as to be parallel to the plate 100. The grinding wheel 112 can be configured to allow free rotation of the grinding wheel 112 about its axle 124. As seen in FIGS. 1, 2, and 4, the grinding wheel 112 can have a have a plurality of projections 114. The projections 114 can extend from the outer surface of the grinding wheel 112 such that as the surface processing device is passed over a surface, the projections 114 can make contact with the surface. In some embodiments, at least one projection 114 can be in the shape of a cone, pyramid, cylinder, or prism. The projections 114 can be perpendicular to the outer surface the grinding wheel 112. The grinding wheel 112 and projections 114 can be made of a hard material, such as metal or metal alloy, where the grinding wheel 112 and projections 114 are capable of treating surfaces without substantial wear.

In addition, or in the alternative, to projections 114, the grinding wheel 112 can have a smooth surface, a textured surface, a grooved surface, a channeled surface, an undulated surface, etc. The surface of the grinding wheel 112 can include abrasive material (diamond grinds, carbide grinds, silica particles, etc.) attached or adhered thereto. It is contemplated for the surface of the grinding wheel 112 and/or projections 114 to be made of hard material (e.g., material that is harder than the material of the surface being processed); however, it need not be. Any one or combination of grinding wheels 112 can have a surface configuration or projection 114 arrangement that is the same or different from another grinding wheel 114.

The selection of the surface configuration and/or projection 114 arrangement of the grinding wheel(s) 112 can depend on which type of surface processing or surface treatment is desired (e.g., cleaning treatment, textured treatment, polishing treatment, burnishing treatment, pitted treatment, etc.), which type of material (e.g., concrete, cement, metal, stone, brick, etc.) is being treated, etc.

As noted herein, the device is configured such that any one or combination of the grinding wheels 112 make contact with the surface to be treated. Making contact can allow the surface of the grinding wheel 112 or projection(s) 114 of the grinding wheel 112 to contact the surface and perform work on the surface. Performing work can include grinding, abrading, cutting, scraping, scratching, heating (via friction), wearing, polishing, etc. As will be explained herein, the device can be attached to an apparatus that cause the device to rotate or revolve. As the device rotates or revolves, the grinding wheel(s) 112 make contact with the surface to be treated and performs work on the surface.

Figure 7:
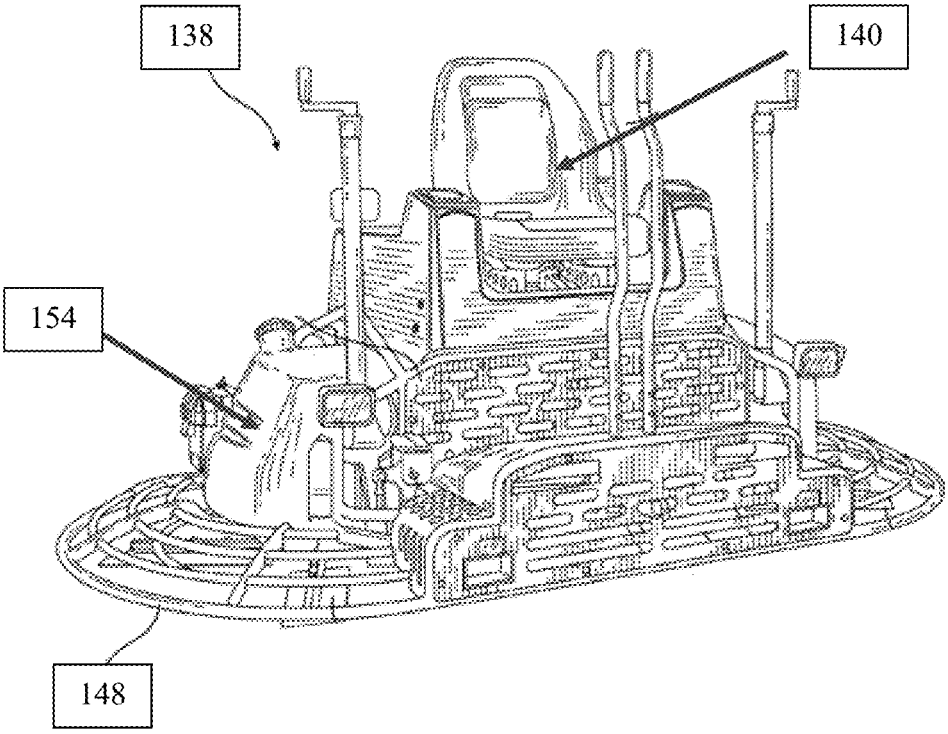
FIG. 7 shows a conventional ride-on surface processing machine (top image) and a conventional walk behind surface processing machine (bottom image).
Figure 7:
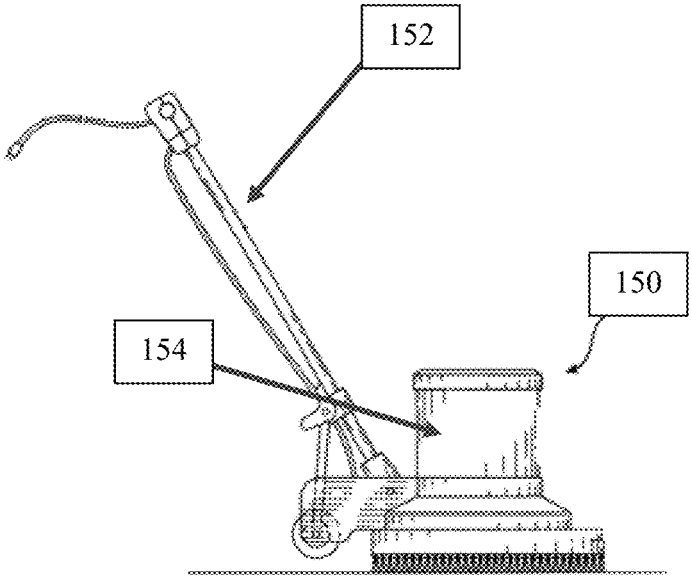

An embodiment of a surface processing device can be configured to be used with or attached to a conventional ride-on surface processing machine 138. The top image of FIG. 7 shows an exemplary embodiment of a conventional ride-on surface processing machine 138. A conventional ride-on surface processing machine 138 comprises an operator seating and control station 140, an engine 154, and at least two downwardly projecting spider assemblies 142. Each spider assembly 142 include a central hub 146 from which at least one spider arm 144 radially extends. The assemblies 142 can each have a plurality of radially-extending, spaced-apart arms 144, each configured for mounting a surface processing device thereto. The spider arm assembly 142 is caused to rotate about an axis of the central hub 146 (the central hub 146 is caused to rotate which causes the spider arm assembly 142 to rotate), and thus the device(s) being connected to the spider arm(s) 144 revolve about the central hub 146. Connected to the spider arm 144, the plate 100 of a surface processing device can spin freely about its mounting axis $M_1$ which is perpendicular to the spider arm 144. Alternatively, the ride-on surface processing 138 machine comprises at least two downwardly projecting rotors 160 in lieu of the spider assemblies 142. Each rotor 160 can be configured to facilitate attachment of a surface processing device thereto such that as the rotor 160 spins, the surface processing device spins as well (e.g., the device rotates about an axis of the rotor 160). Connected to the rotor 160, the mounting axis $M_1$ of the plate 100 is parallel with the axis of rotation of the rotor 160. Whether configured to a spider arm 144 or a rotor 160, the grinding wheels 112 of the mounted surface processing device can make contact with the surface beneath the ride-on surface processing machine 138. A surface processing device configured to a ride-on surface processing machine 138 can be encircled by a guard ring cage 148 or a similar protective shield.

An embodiment of a surface processing device can be configured to be used with or attached to a conventional walk-behind surface processing machine 150. The bottom image of FIG. 7 shows an exemplary embodiment of a conventional ride-on surface processing machine 138. A walk-behind surface processing machine 150 comprises a handle 152 for machine control and steering, an electric or gas engine 154, and a downwardly projecting spider assembly 142. The spider assembly 142 can include a central hub 146 from which at least one spider arm 144 radially extends. The assembly 142 can have a plurality of radially-extending, spaced-apart arms 144, each configured for mounting a surface processing device thereto. The spider arm assembly 142 is caused to rotate about an axis of the central hub 146 (the central hub 146 is caused to rotate which causes the spider arm assembly 142 to rotate), and thus the device(s) being connected to the spider arm(s) 144 revolve about the central hub 146. Connected to the spider arm 144, the plate 100 of a surface processing device can spin freely about its mounting axis $M_1$ which is perpendicular to the spider arm 144. Alternatively, the walk-behind surface processing machine 150 (e.g., an electric floor buffer machine) comprises a downwardly projecting rotor 160 in lieu of the spider assembly 142. The rotor 160 can be configured to facilitate attachment of a surface processing device thereto such that as the rotor spins, the surface processing device spins as well (e.g., the device rotates about an axis of the rotor 160). Connected to the rotor 160, the mounting axis $M_1$ of the plate 100 is parallel with the axis of rotation of the rotor 160. Whether configured to a spider arm 144 or a rotor 160, the grinding wheels 112 of the mounted surface processing device can make contact with the surface beneath the walk-behind surface processing machine 150. A surface processing device configured to a walk-behind surface processing machine 150 can be encircled by a guard ring cage 148 or a similar protective shield.

An embodiment of a surface processing device can be configured to be used with or attached to a conventional hand-held surface processing machine. A hand-held surface processing machine comprises a housing, a handle portion on the housing for machine direction and control, a motor disposed in the housing, and an outwardly projecting rotor 160 driven to rotate by the motor. The rotor 160 can be configured to facilitate attachment of a surface processing device thereto such that as the rotor spins, the surface processing device spins as well (e.g., the device rotates about an axis of the rotor 160). Connected to the rotor 160, the mounting axis $M_1$ of the plate 100 is parallel with the axis of rotation of the rotor 160. Configured to a rotor 160, the grinding wheels 112 of the mounted surface processing device can make contact with the surface targeted by the hand-held surface processing machine. A surface processing device configured to a hand-held surface processing machine can be encircled by a guard ring cage 148 or a similar protective shield.

An exemplary embodiment relates to a method of polishing a surface using an embodiment of a surface processing device. The embodiment of the surface processing device can comprise a plate 100, a bearing 106, and a plurality of bush heads 108. The plate 100 has a top 102 and bottom 104. The bearing 106 can be attached to the top of the plate 102 to facilitate rotation of the plate 100. The plurality of bush heads 108 can be attached to the bottom of the plate 104. Each bush head comprises a bracket 110 and a grinding wheel 112. The method can involve attaching the surface processing device to a spider arm 144 of a rotatable spider assembly 142 so that the bottom of the plate 104 faces towards the surface. The rotatable spider assembly 142 can have an axis of rotation perpendicular to the plate 100. The method can involve causing the spider arm 144 to rotate about the axis of rotation. The method can involve allowing the plurality of bush heads 108 to make contact with the surface as the spider arm 144 rotates.

In can be appreciated in the aforementioned embodiment that the surface processing device is capable of passive planetary rotation. Passive planetary rotation can be the free rotation of the pivotally attached bush heads 108 relative to the plate 100 and the free rotation of the plate 100 relative to the spider arm 144 via the bearing 106. The passive planetary rotation can allow the spider arm 144 to rotate in one direction while the plate 100 rotates in the opposite direction (e.g., as the spider arm 144 is rotated clockwise, the plate 100 rotates counterclockwise). This counter rotation can facilitate an improved operation and enhanced preparation of the surface. Without passive planetary rotation, the rotation of the plate 100 can cause a scarification pattern (e.g., distinct circular patterns on the surface) which is undesirable. Scarification patterns are not only unaesthetic but functionally detrimental. For example, scarification patterns on the surface can reduce the mechanical gripping or adhesion of subsequent finishing layers placed on top of the surface (e.g. overlay). It will be apparent to those skilled in the art that any embodiment of the surface processing device is capable of passive planetary rotation if that embodiment enables free rotation of the pivotally attached bush heads 108 relative to the plate 100 and the free rotation of the plate 100 relative to the spider arm 144 via the bearing 106. An exemplary embodiment relates to a method of polishing a surface using an embodiment of a surface processing device. The embodiment of the surface processing device can comprise a plate 100, a rotor adaptor 162, and a plurality of bush heads 108. The plate 100 has a top 102 and bottom 104. The rotor adaptor 162 can be attached to the top of the plate 102 to facilitate rotation of the plate 100. The plurality of bush heads 108 can be attached to the bottom of the plate 104. Each bush head comprises a bracket 110 and a grinding wheel 112. The method can involve attaching the surface processing device to a rotor 160 so that the bottom 104 of the plate 100 faces towards the surface. The rotor 160 can have an axis of rotation perpendicular to the plate 100. The method can involve causing the rotor 160 to rotate about its axis of rotation. The surface processing device is configured in such a way that as the rotor 160 spins, the surface processing device spins as well. The method can involve allowing the plurality of bush heads 108 to make contact with the surface as the rotor 160 rotates.

It should be understood that modifications to the embodiments disclosed herein can be made to meet a particular set of design criteria. For instance, the number or configuration of components or parameters may be used to meet a particular objective.

It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features or parts of other embodiments. The elements and acts of the various embodiments described herein can therefore be combined to provide further embodiments.

It is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of the device and methods of making and using the same have been discussed and illustrated herein, it is to be distinctly understood that the invention is not limited thereto but may be otherwise variously embodied and practiced within the scope of the following claims.

What is claimed is:

1. A surface processing device, comprising:

a plate, the plate having a top and bottom;

a bearing attached to the top of the plate to facilitate rotation of the plate, the bearing being configured to engage with a spider arm of a rotatable spider assembly; and a plurality of bush heads attached to the bottom of the plate, each bush head comprising a bracket and a grinding wheel, each grinding wheel having an axis of rotation that is parallel with the plate and an axis of rotation that is perpendicular to the plate;

wherein the surface processing device is capable of passive planetary rotation by:

the bearing configured to allow free rotation of the plate relative to the spider arm, a plurality of pivotal attachments in which each pivotal attachment is interposed between the plate and the plurality of bush heads, respectively, and each pivotal attachment of the plurality of pivotal attachments is configured to allow free rotation of each bush head of the plurality of bush heads relative to the plate, respectively; and the rotatable spider arm rotates in a first direction, the plate rotates in a direction counter to the first direction, and each of the plurality of bush heads freely rotates.

2. The surface processing device of claim 1, wherein the plurality of bush heads includes four bush heads.

3. The surface processing device of claim 1, wherein at least one bush head of the plurality of bush heads includes a plurality of projections on its grinding wheel.

4. The surface processing device of claim 3, wherein at least one projection of the plurality of projections is in a shape of a cone, a pyramid, a cylinder, or a prism.

5. The surface processing device of claim 1, wherein at least one bush head of the plurality of bush heads is removably attached to the bottom of the plate.

6. The surface processing device of claim 1, wherein at least one bush head of the plurality of bush heads includes an axle connected to its grinding wheel.

7. The surface processing device of claim 6, wherein the respective at least one bush head of the plurality of bush heads is configured to allow free rotation of the respective grinding wheel about its axle.

8. The surface processing device of claim 1, wherein the plate has a circular profile.

9. The surface processing device of claim 8, wherein the plate has a center and the plurality of bush heads are equidistant from the center of the plate.

10. The surface processing device of claim 1, wherein the plate has a bolt circle and the plurality of bush heads are equally spaced on the bolt circle.

11. A method for polishing a surface with a surface processing device comprising: a plate, the plate having a top and bottom; a bearing attached to the top of the plate to facilitate rotation of the plate; and a plurality of bush heads attached to the bottom of the plate, each bush head comprising a bracket and a grinding wheel, each grinding wheel having an axis of rotation that is parallel with the plate and an axis of rotation that is perpendicular to the plate, the method comprising:

attaching the surface processing device to a spider arm of a rotatable spider assembly so that the bottom of the plate faces towards the surface, the rotatable spider assembly having an axis of rotation;

causing the spider arm to rotate about the axis of rotation of the rotatable spider assembly; and allowing the plurality of bush heads to make contact with the surface as the spider arm rotates;

allowing the surface processing device to operate in a passive planetary rotation arrangement due to free rotation of the plate relative to the spider arm and free rotation of each bush head of the plurality of bush heads relative to the plate such that the rotatable spider arm rotates in a first direction, the plate rotates in a direction counter to the first direction, and each of the plurality of bush heads freely rotates.

12. The method of claim 11, wherein polishing the surface with the surface processing device creates a texturized surface, wherein the texturized surface does not possess a scarification pattern.

* * * * *